United States Patent [19]

Baker et al.

[11] 4,192,378

[45] Mar. 11, 1980

[54] PORT VALVE ISOLATION PACKER

[75] Inventors: Eugene E. Baker; Ernest E. Carter, Jr., both of Duncan, Okla.

[73] Assignee: Halliburton Company, Duncan, Okla.

[21] Appl. No.: 941,753

[22] Filed: Sep. 13, 1978

[51] Int. Cl.[2] ..... E21B 33/122; F16L 35/00

[52] U.S. Cl. ..... 166/186; 166/240; 166/334; 285/81; 285/402

[58] Field of Search ..... 166/240, 147, 152, 127, 166/186, 334; 285/81, 361, 376, 377, 396, 402

[56] References Cited

U.S. PATENT DOCUMENTS

| | | | |
|---|---|---|---|
| 1,874,673 | 8/1932 | Waters | 166/240 |
| 2,122,749 | 7/1938 | Morrisett | 166/240 |
| 2,736,384 | 2/1956 | Potts | 285/81 |
| 3,169,580 | 2/1965 | Bateman | 166/152 |
| 3,391,743 | 7/1968 | Bateman | 166/186 |
| 3,396,798 | 8/1968 | Burns et al. | 166/186 |
| 4,103,741 | 8/1978 | Daigle | 166/152 |

*Primary Examiner*—James A. Leppink

*Attorney, Agent, or Firm*—John H. Tregoning; James R. Duzan; Lucian W. Beavers

[57] ABSTRACT

A port valve isolation packer comprises an upper body, a slip joint port valve, a positioner mandrel, a spacer coupling and a lower body, all of which make up a tubular body of the isolation packer. Said tubular body has upper and lower packer assemblies and a closing positioner attached to its outer surface. An inner mandrel is concentrically disposed within said tubular body. The slip joint port valve includes a slip joint mandrel having a port disposed therein, and a slip joint sleeve having a radial bore therethrough. When said port valve is in a first closed position, said port is blocked by said slip joint sleeve. When said port valve is in a second open position, said port is aligned with the radial bore of the slip joint sleeve. The inner bore of the inner mandrel communicates with said port. A fluid bypass is provided through an annular cavity between the inner mandrel and the tubular body.

17 Claims, 8 Drawing Figures

PORT VALVE ISOLATION PACKER

In preparing oil well boreholes for oil and/or gas production a most important step involves the process of cementing.

Basically, oil well cementing is a process of mixing a cement-water slurry and pumping it down through steel casing to critical points located in the annulus around the casing in the open hole below, or in fractured formations.

Cementing a well protects possible productive zones behind the casing against salt water flow and protects the casing against corrosion from subsurface mineral waters and electrolysis from the outside.

Cementing eliminates the danger of fresh drinking and recreational water supply strata from being contaminated by oil or salt water flow through the bore hole from those types of formations. It prevents oil well blowouts and fires caused by high pressure gas zones behind the casing and in addition prevents the collapsing of the casing from high external pressures building up underground.

A cementing operation for protection against the above described downhole conditions is called primary cementing. Secondary cementing includes the cementing processes used on a well during its productive life and includes remedial cementing and repairs to existing cemented areas.

The present invention is directed primarily to the first type of cementing operation, primary cementing.

In the early days of oil field production when wells were all relatively shallow, cementing was accomplished by flowing the wet cement slurry down the casing and back up the outside of the casing in the annulus between the casing and the borehole wall.

As wells were drilled deeper and deeper to locate petroleum products, it became difficult to cement the entire well satisfactorily from the bottom of the casing and multiple stage cementing was developed to allow the annulus to be cemented in separate stages, beginning at the bottom of the well and working up.

This process was achieved by placing cementing valves in the casing or between joints of casing at one or more locations in the borehole, flowing through the bottom of the casing, up the annulus to the lowest valve in the wall, closing the bottom and then flowing through the valve to the next higher valve, then repeating until the cement reached the uppermost annulus region to be cemented.

More recently, a full opening cementing tool, capable of performing an unlimited number of cementing stages in a deep well, has been developed. Such a tool is disclosed in U.S. Pat. No. 3,768,562 to Baker, assigned to the assignee of the present invention, and comprises one or more ported cylindrical housings interposed in the casing string, a valve sleeve telescopically located in a recessed area in each housing and capable of opening and closing the ports in the housing for cement flow, and an opening positioner and a closing positioner to be used on a drill string in conjunction with the closing sleeves and the housings. In addition, the use of that device is advantageously coupled with one or more cementing plugs, isolation packers, and circulating valves to perform various types of cementing operations under various down hole conditions.

Variations of the device of U.S. Pat. No. 3,768,562 are shown in U.S. Pat. No. 3,948,322 and No. 4,105,069, both to Baker and assigned to the assignee of the present invention.

The present invention includes an improved isolation packer for use with the full opening cementing tools just described, and which is particularly adapted for use in inner string cementing procedures such as those illustrated in and described in relation to FIGS. 9 and 10 of U.S. Pat. No. 3,768,562 to Baker.

It has been determined that the isolation packer of U.S. Pat. No. 3,768,562, having port hole 103 which is always open communicating the inside of the drill string with the inner annulus between the drill string and the casing, is not always suitable for inner string cementing procedures. For example, if the hydrostatic head within the drill string drops due to a shut down of the pump connected thereto, and if the outer annulus between the casing and the borehole is not completely filled with working fluid, the column of cement in the drill string will seek to balance with the column of fluid in the outer annulus. In so doing, the level of the cement column within the drill string may drop so low that the hydrostatic head inside the drill string at the level of port hole 103 (see FIG. 9 of U.S. Pat. No. 3,768,562) may be less than the hydrostatic head of the column of fluid in the inner annulus at that same level. Under those conditions, drilling mud from the inner annulus may flow down bypass channel 105, upwards past lower packer 92, and into the drill string thereby contaminating the cement therein.

This problem is alleviated in the present invention by the provision of a slip joint port valve which replaces the port hole 103 of U.S. Pat. No. 3,768,562. This slip joint valve automatically closes the port during first stage inner string cementing. When the weight of the drill string is set down on the port valve isolation packer of the present invention, the slip joint valve closes off the cementing port to prevent contamination of the cement. During second, third and later stage cementing the weight of the isolation packer as well as cementing pressure within the drill string hold the port in the open position.

Use of the port valve isolation packer allows the inner string primary stage cementing and the later stage cementing, done with the full opening cementing tool, to be completed with only one trip of the drill string. Otherwise, to avoid the possibility of cement contamination upon pump shut down, when cementing the primary stage by the inner string method, it is necessary to first run the drill string without the isolation packer to cement the primary stage. Then the drill string must be pulled, the isolation packer added, and then the drill string is run into the hole again to complete the later stages of the cementing job.

FIGS. 1 and 1A comprise a sectional elevation view of the port valve isolation packer of the present invention. FIG. 1 shows the upper portion and FIG. 1A shows the lower portion.

FIG. 6 is a sectional elevation view of the slip joint mandrel taken along lines 6—6 of FIG. 4.

Figure 1:
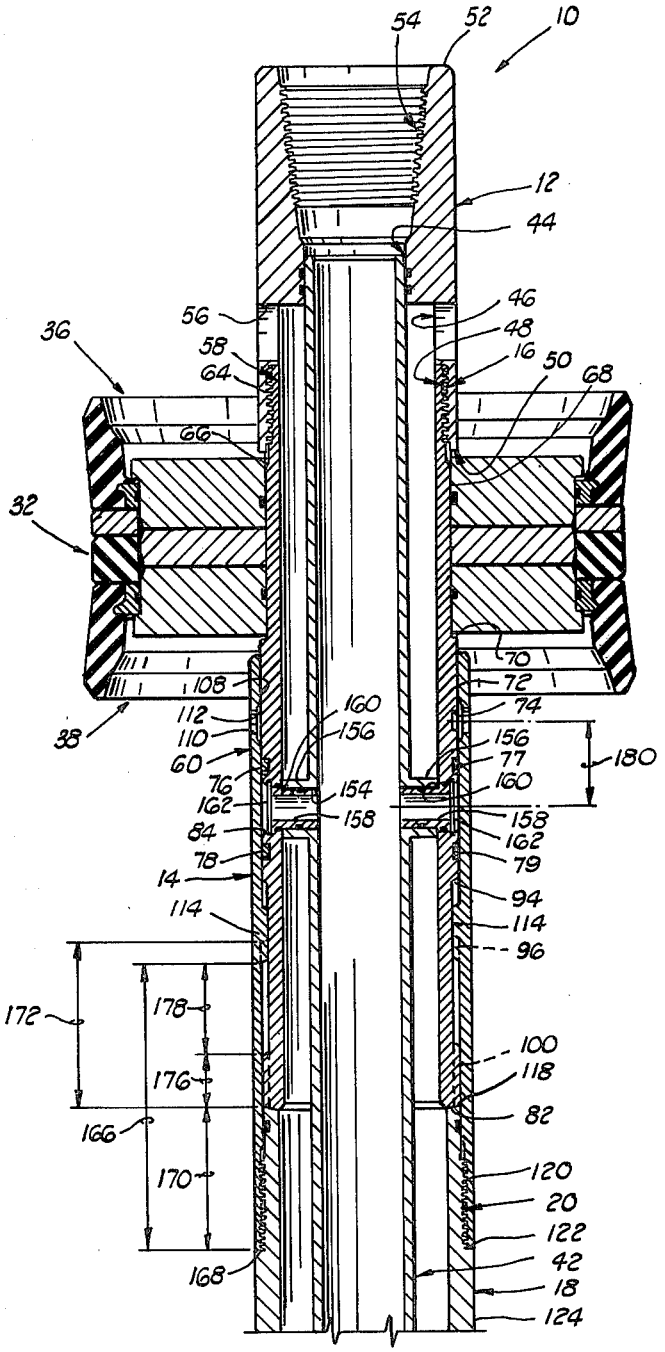
Figure 1A:
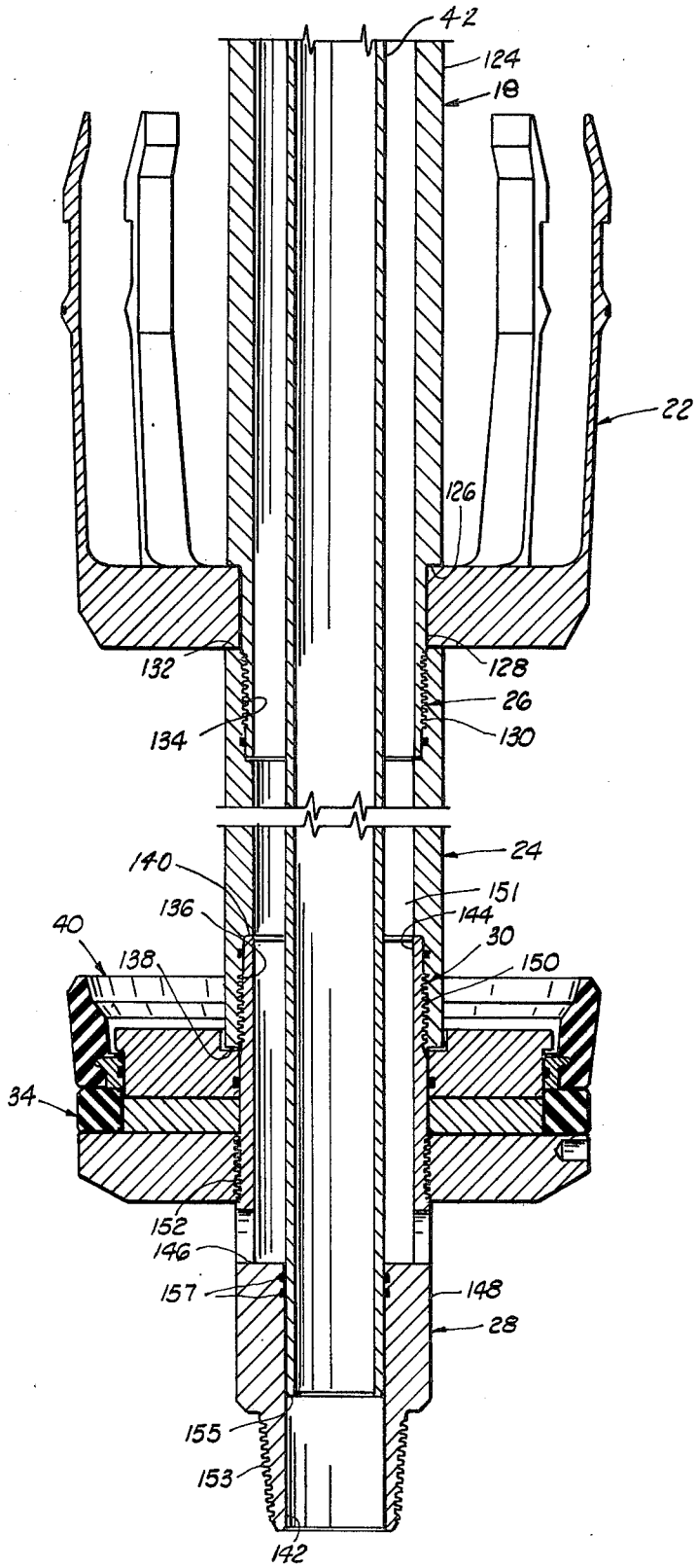

Referring now to the drawings, and particularly to FIGS. 1 and 1A, the port valve isolation packer of the present invention is shown and generally designated by the numeral 10. Isolation packer 10 includes an upper body 12 which is connected to an upper end of a slip joint port valve 14 at threaded joint 16. The lower end of slip joint port valve 14 is connected to positioner mandrel 18 at threaded joint 20. Located near the lower end of positioner mandrel 18 is a sleeve closing positioner 22. The lower end of positioner mandrel 18 is connected to spacer coupling 24 at threaded joint 26. The lower end of spacer coupling 24 is connected to lower body 28 at threaded joint 30.

The upper body 12, port valve 14, positioner mandrel 18, sleeve closing positioner 22, spacer coupling 24 and lower body 28 comprise a tubular body of isolation packer 10.

An upper packer assembly 32 is located on slip joint port valve 14 just below threaded joint 16. A lower packer assembly 34 is located on lower body 28 just below threaded joint 30. Upper packer assembly 32 comprises first and second sealing cups 36 and 38 which are circular cups made of an elastomeric material which is capable of sealingly engaging the interior of an oil well casing. Cup 36 on upper packer assembly 32 is facing upwards and is capable of sealing flow of fluids in a downward direction, which downward flow presses into cup 36 and spreads it out into sealing contact with the oil well casing. Cup 38 is concave downward and suitable for sealing against upward flow in the same manner as cup 36 seals against downward flow.

Lower packer assembly 34 comprises only one third elastomeric cup 40 which is arranged concave upward for preventing downward flow thereby. Lower packer assembly 34 does not prevent upward flow past it through an inner annulus between isolation packer 10 and the oil well casing.

Concentrically located within port valve isolation packer 10 is inner mandrel 42 which is closely received at its upper and lower ends by upper and lower bodies 12 and 28, respectively.

The port valve isolation packer 10 is designed for use with a full opening cementing tool such as that described in U.S. Pat. No. 3,768,562 to Baker which is hereby incorporated herein by reference. Port valve isolation packer 10 is typically installed in the drill string along with other associated apparatus in the same manner as the prior art fixed port isolation packer illustrated in FIG. 6 of U.S. Pat. No. 3,768,562.

The details of construction of port valve isolation packer 10 will now be described. Directions or orientations parallel to the central longitudial axis of inner mandrel 42 are referred to as axial. Directions or orientations normal to and intersecting that axis are referred to as radial.

Upper body 12 is cylindrical in shape, and has disposed therethrough an axial bore 44 and first and second concentric counterbores 46 and 48, respectively, communicating with a lower end surface 50 of upper body 12. Communicating with an upper end surface 52 of upper body 12 is a threaded conical downwardly converging concentric counterbore 54. Counterbore 54 is constructed to receive a similarly shaped threaded end of a drill string pipe. A radial bore 56 intersects first counterbore 46. Second counterbore 48 has an internal thread at threaded joint 16.

Slip joint port valve 14 includes slip joint mandrel 58 and slip joint sleeve 60. Slip joint mandrel 58 and slip joint sleeve 60 comprise first and second telescoping tubular members, respectively, one of which is concentrically received within the other.

Figure 4:
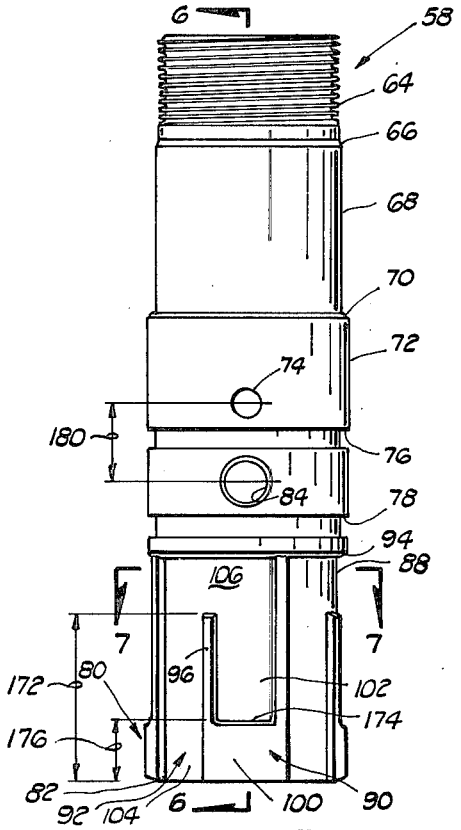
FIG. 4 is an elevation view of the slip joint mandrel of the port valve isolation packer of FIG. 1.

Referring now to FIGS. 4 and 6, slip joint mandrel 58 has an axial bore 62. The cylindrical outer surface of slip joint mandrel 58 has an upper threaded end 64, a sloping shoulder 66, a first raised cylindrical surface 68, a radial shoulder 70, a second raised cylindrical surface 72, a blind spot bore 74 in surface 72, first and second annular grooves 76 and 78, a lower grooved portion 80, and a bottom end surface 82. First and second resilient sealing rings 77 and 79 are located in grooves 76 and 78. A radial bore or port 84 is located between grooves 76 and 78 and intersects axial bore 62. Annular retaining ring grooves 86 are disposed near each end of radial bore 84.

Lower grooved portion 80 is best described with reference to FIGS. 4–7. Slotted portion 80 is comprised of an outer cylindrical surface 88 having four J-shaped raised portions 80 defining four inverted J-shaped grooves 92. Shoulder 94 connects surface 88 to surface 72. Each raised portion 90 includes a first short leg 96 extending from bottom surface 82 partially towards shoulder 94, a second long leg 98 extending from bottom surface 82 to shoulder 94, and a connecting part 100 joining the lower ends of legs 96 and 98.

This defines the inverted J-shaped groove 92 which has a first short leg groove segment 102, a second long leg groove segment 104 and a connecting groove segment 106. The four grooves 92 are equally spaced about the periphery of slip joint mandrel 58.

Figure 2:
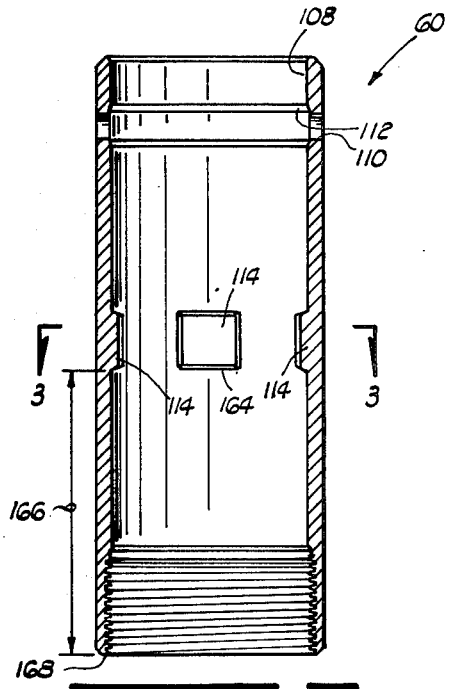
FIG. 2 is a sectional elevation view of the slip joint sleeve of the port valve isolation packer of FIG. 1.
Figure 3:
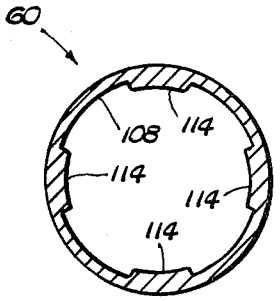
FIG. 3 is a section view of the slip joint sleeve taken along lines 3—3 of FIG. 2.
Figure 5:
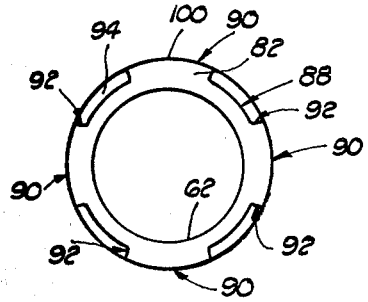
FIG. 5 is a bottom view of the slip joint mandrel of FIG. 4.

Referring now to FIGS. 2 and 3, slip joint sleeve 60 has an inner axial bore 108 intersected near its upper end by radial bore 110. An annular groove 112 is disposed in axial bore 108 adjacent radial bore 110. Below radial bore 110 are located four square lugs 114 projecting radially inward from bore 108. Lugs 114 are equally spaced 90° apart and constructed to be received by inverted J-shaped grooves 92 of slip joint mandrel 58. The lower end of axial bore 108 includes an internally threaded part 116 for making up threaded joint 20.

When slip joint port valve 14 is in its open position, radial bores 110, 84 and 154 are aligned to form a port communicating an inner cavity of inner mandrel 42 with an outer surface of slip joint sleeve 60.

Positioner mandrel 18 includes an upper end surface 118, an upper externally threaded portion 120 for making up threaded joint 20, first radial shoulder 122, raised cylindrical surface 124, second radial shoulder 126, second cylindrical surface 128 and lower externally threaded portion 130.

Closely received on second cylindrical surface 128 is sleeve closing positioner 22.

Spacer coupling 24 has upper end surface 132, upper internal threaded portion 134, lower internal threaded portion 136 and lower end surface 138.

Lower body 28 includes upper end surface 140, axial bore 142 and axial counterbore 144 communicating with upper surface 140. Radial bore 146 intersects the lower end of counterbore 144. Outer cylindrical surface 148 of lower body 28 includes a first external threaded portion 150 near its upper end, a second external threaded portion 152 located between first threaded portion 150 and radial bore 146 and a third reduced diameter conical downwardly tapered external pipe thread portion 153 at its lower end. Pipe threads 153 allow the lower body 28 to be connected to another section of the drill string.

Radial bores 56 and 146, along with an annular cavity 151 between mandrel 42 and the other components of isolation packer 10, comprise a bypass communicating an outer cylindrical surface of upper body 12 with an outer cylindrical surface 148 of lower body 28 below lower packer assembly 34. This permits working fluid within the annular space between isolation packer 10 and the oil well casing to flow past isolation packer 10 when isolation packer 10 is being moved up or down within the casing. Annular cavity 151 is in fluid isolation from the inner bore of inner mandrel 42.

Inner mandrel 42 is closely received at its upper end with axial bore 44 of upper body 12, and at its lower end within axial bore 142 of lower body 28. A lower end 155 of inner mandrel 42 extends a distance below resilient seals 157, between inner mandrel 42 and axial bore 142, said distance being greater than the axial distance 178 which slip joint sleeve 60 can travel relative to slip joint mandrel 58. A central portion of inner mandrel 42 has a radial bore 154 therethrough. Extending radially outward from, and concentric with each end of radial bore 154 are two nipples 156 whose radially outer ends are constructed to closely fit axial bore 62 of slip joint mandrel 58. Radial bore 154 of inner mandrel 42 is aligned concentric with radial bore 84 of slip joint mandrel 58. A port valve nozzle 158 is inserted through each outer end of bore 84 into nipples 156 until a shoulder 160 thereof engages a radially outer end of the respective nipple 156. Each nozzle 158 is held in place by a retaining ring 162 inserted in one of the grooves 86.

Upper packer assembly 32 is located on surface 68 of slip joint mandrel 58 and is held in place between lower end 50 of upper body 12 and shoulder 70 of slip joint mandrel 58 when threaded joint 16 is made up.

Lower packer assembly 34 is located on outer surface 148 of lower assembly 28 and is held in place by lower end 138 of spacer coupling 24 and a threaded engagement with threaded portion 152.

The proper operation of port valve isolation packer 10, and particularly of slip joint port valve 14 is dependent upon the relative dimensions of the various features of the slip joint port valve 14 and the other elements connected thereto.

To assemble the slip joint port valve 14, the inner mandrel 42 is first positioned within slip joint mandrel 58 and nozzles 158 are inserted along with retaining rings 162.

Figure 7:
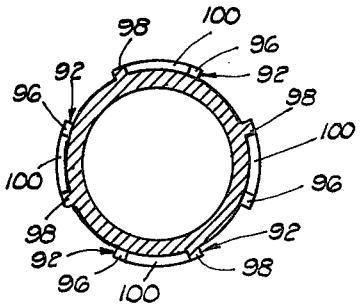
FIG. 7 is a sectional view of the slip joint mandrel taken along lines 7—7 of FIG. 4.
Figure 8:
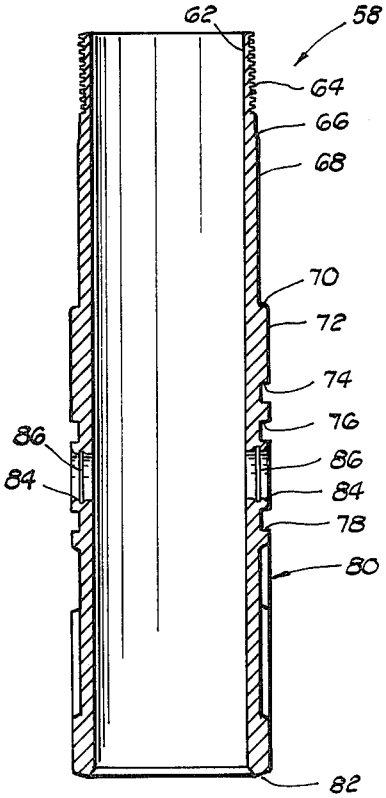

Then slip joint sleeve 60 is attached by sliding lugs 114 into long leg groove segments 104 from below, rotating slip joint sleeve 60 approximately 45° counterclockwise relative to slip joint mandrel 58, as viewed in FIG. 7, and then lowering lugs 114 into short leg groove segments 102. The upper end surface 118 of positioner mandrel 18 is then inserted in axial bore 108 of slip joint sleeve 60 from below and threaded joint 20 is made up until a lower end surface 168 of slip joint sleeve 60 engages first radial shoulder 122 of positioner mandrel 18.

A lower edge 164 of lugs 114 is located a first distance 166 from the lower end surface 168 of slip joint sleeve 60. The upper end surface 118 of positioner mandrel 18 is located a second distance 170 above shoulder 122 and lower end surface 168. The short legs 96, of J-shaped raised portions 90, extend a third distance 172 upward from bottom surface 82 of slip joint mandrel 58. Upward travel of slip joint sleeve 60 relative to slip joint mandrel 58 is limited by engagement of bottom surface 82 of slip joint mandrel 58 with upper end surface 118 of positioner mandrel 18.

Slip joint port valve 14 is constructed so that the difference between first distance 166 and second distance 170 is less than third distance 172. Once threaded joint 20 is made up so that bottom end surface 168 engages shoulder 122, this dimensional relationship prevents lugs 114 from being raised above the upper end of short legs 96. Lugs 114 are confined to an axial movement within short leg groove segments 102. This prevents the disassembly of slip joint mandrel 58 and slip joint sleeve 60 unless positioner mandrel 18 is first disconnected from slip joint sleeve 60.

The lower extent of this axial movement of lugs 114 is defined by engagement of lugs 114 with an upper edge 174 of connecting portions 100 of J-shaped raised portions 90. Upper edge 174 is located a fourth distance 176 above bottom surface 82 of slip joint mandrel 58.

The total extent of axial movement of lugs 114, or the travel of slip joint port valve 14, is equal to a fifth distance 178 which is equal to first distance 166 minus the sum of second distance 170 and fourth distance 176.

The blind spot bore 74 is axially spaced a sixth distance 180 above radial bore 84, centerline to centerline. Sixth distance 180 is equal to the travel 178. In this manner, when the slip joint port valve 14 is in its first closed position illustrated in FIG. 1, the radial bore 110 of slip joint sleeve 60 is aligned with blind spot bore 74. Since blind spot bore 74 is located directly above radial bore 84 of slip joint mandrel 58, the visual sighting of spot bore 74 through radial bore 110 assures the operator that the radial bores 110 and 84 will be properly aligned when slip joint port valve 14 is moved to its second open position with lower edges 164 of lugs 114 engaging upper edge 174 of connecting portions 100 of J-shaped raised portions 90.

When port valve isolation packer 10 is being used to perform primary stage inner string cementing procedures (as illustrated in FIG. 10 of U.S. Pat. No. 3,768,562) the weight of the drill string setting down on the bottom of the oil well bore hole subjects slip joint port valve 14 to sufficient compressional force to move it to its first closed position illustrated in FIG. 1, so that the cementing ports are closed thereby preventing contamination of the cement should the cement pump be shut down.

After the primary stage is completed and the port valve isolation packer 10 is lifted to a position adjacent a casing valve to perform a second stage of cementing, the weight of the slip joint sleeve 60 and those components attached below sleeve 60 along with the internal cementing pressure, subject the port valve 14 to sufficient tensional pressure to move it to its second open position thereby opening the cementing ports.

Thus, the port valve isolation packer of the present invention is well adapted to obtain the ends and advantages mentioned, as well as those inherent therein. While presently preferred embodiments of the invention have been described for the purpose of this disclosure, numerous changes in the construction and arrangement of parts can be made by those skilled in the art, which changes are encompassed within the spirit of this invention as defined by the appended claims.

What is claimed is:

1. A slip joint connection between first and second telescoping tubular members, one of said tubular members being concentrically received within the other of said tubular members, comprising:

a lug attached to said first tubular member;

a J-shaped groove disposed in said second tubular member, said J-shaped groove having a long leg groove segment extending axially from a first end surface of said second tubular member, having a short leg groove segment with its end nearest said first end surface being closed, and having a connecting groove segment between said long and short leg groove segments, said lug being constructed for insertion in the end of said long leg groove segment adjacent said first end surface and movement through said connecting groove segment into said short leg groove segment; and means for restricting relative axial motion between said first and second tubular members, after said lug is located in said short leg groove segment, so that the furthest position of said lug within said short leg groove segment away from said first end surface of said second tubular member is closer to said first end surface than is said connecting groove segment at its junction with said short leg groove segment.

2. A slip joint port valve, including the slip joint connection of claim 1, wherein:

said first tubular member includes a slip joint sleeve, having a radial bore therethrough;

said second tubular member includes a slip joint mandrel, having a port disposed radially therein, said port being oriented so that it is closed by said sleeve when said valve is in a first closed position and so that it is aligned with said radial bore in said sleeve when said valve is in a second open position.

3. A slip joint port valve, including a slip joint connection between first and second telescoping tubular members, one of said tubular members being concentrically received within the other of said tubular members, wherein:

said first tubular member has a lug attached thereto and includes a slip joint sleeve having a radial bore therethrough;

said second tubular member includes:

a slip joint mandrel having a port disposed radially therein, said port being oriented so that it is closed by said sleeve when said valve is in a first closed position and so that it is aligned with said radial bore in said sleeve when said valve is in a second open position; and a J-shaped groove disposed in said second tubular member, said J-shaped groove having a long leg groove segment extending axially from a first end surface of said slip joint mandrel and having a short leg groove segment with its end nearest said first end surface being closed, said lug being constructed for insertion in the end of said long leg groove segment adjacent said first end surface and movement through said J-shaped groove into said short leg groove segment; and said slip joint port valve further includes means for restricting relative axial motion between said first and second tubular members, after said lug is located in said short leg groove segment so that said lug is retained in said short leg groove segment, said restricting means including a third tubular member received within an end of said slip joint sleeve, so that the furthest position of said lug within said short leg groove segment away from said first end surface of said slip joint mandrel is determined by engagement of said first end surface with said tubular member.

4. An isolation packer, comprising:

a tubular body;

an upper packer assembly, attached to said body;

a lower packer assembly, attached to said body;

a port, located between said upper and lower packer assemblies, communicating an inner cavity of said tubular body with an outer surface of said tubular body;

wherein said tubular body includes a slip joint port valve means, connected between said upper and lower packer assemblies, said valve means being moveable between a first position closing said port when a compressive axial force is applied across said tubular body, and a second position opening said port when a tensile axial force is applied across said tubular body, said valve means including:

a slip joint mandrel having said port disposed radially therethrough, said mandrel including an inverted J-shaped groove, having a long leg groove segment and a short leg groove segment with a connecting groove segment joining an upper end of said long and short leg segments and with a lower end of said long leg segment communicating with a bottom end surface of said slip joint mandrel; and a slip joint sleeve slidingly engaging said slip joint mandrel, said sleeve including a radial bore disposed therethrough for alignment with said port when said valve is in said second open position, and including a lug constructed for insertion into the lower end of said long leg groove segment and for movement through said long leg segment and said connecting segment into said short leg segment, wherein said isolation packer further comprises;

a means for retaining said lug in said short leg groove segment, so that said lug remains in said short leg groove segment and reciprocates therein when said valve means is moved between said first and second positions.

5. Apparatus of claim 4, wherein:

said valve is constructed so that said slip joint mandrel is moved upward relative to said sleeve when said valve is moved from said first closed position to said second open position.

6. Apparatus of claim 4, wherein:

said retaining means comprises a tubular member attached to a lower internal cylindrical surface of said sleeve so that an upper end surface of said tubular member engages a lower end surface of said slip joint mandrel when said valve is in said first closed position.

7. Apparatus of claim 4, wherein:

said slip joint mandrel has a blind spot bore located therein, directly above said port, for alignment with said radial bore in said sleeve when said valve is in said first closed position.

8. Apparatus of claim 4, further comprising:

first and second resilient seals located between said slip joint mandrel and said slip joint sleeve, said first and second seals being located above and below said port, respectively.

9. Apparatus of claim 4, further comprising:

a bypass, communicating an outer cylindrical surface of said tubular body above said upper packer assembly with an outer cylindrical surface of said tubular body below said lower packer assembly.

10. Apparatus of claim 9, wherein:

said inner cavity of said tubular body is an inner cavity of an inner mandrel located within said tubular body; and said bypass includes an annular cavity between said inner mandrel and said tubular body, and upper and lower radial bores through said tubular body, said upper and lower bores intersecting said annular cavity above said upper packer assembly and below said lower packer assembly, respectively.

11. Apparatus of claim 10, wherein:

said inner mandrel has a radial bore disposed therethrough and aligned with said port.

12. Apparatus of claim 11, further comprising:

a nozzle, inserted in said port and said radial bore of said inner mandrel to retain said port in alignment with said radial bore of said inner mandrel.

13. Apparatus of claim 10, wherein:

a lower end of said inner mandrel is closely received within an axial bore of a lower portion of said tubular body, and when said valve is in said first closed position said lower end of said inner mandrel extends a distance below a resilient seal between said inner mandrel and said axial bore, said distance being greater than a distance traveled by said sleeve relative to said slip joint mandrel when said valve is moved from said first closed position to said second open position.

14. A port valve isolation packer, comprising:

an upper body;

a slip joint port valve, connected to said upper body;

a positioner mandrel, connected to said port valve;

a spacer coupling connected to said positioner mandrel;

a lower body, connected to said spacer coupling;

an inner mandrel, having an upper and a lower end communicating with axial bores of said upper and lower bodies, respectively, and having a radial bore communicating with a port in said port valve;

an upper packer assembly, connected to said slip joint port valve above said port;

a closing positioner, connected to said positioner mandrel; and a lower packer assembly, connected to said lower body.

15. Apparatus of claim 14, wherein:

said upper packer assembly includes first and second sealing cups for sealingly engaging the interior of an oil well casing, said first cup being located above said second cup and being concave upwards to seal against flow of fluids in a downward direction, and said second cup being concave downwards to seal against flow of fluids in an upward direction;

said lower packer assembly includes a third cup, said third cup being concave upwards;

said port valve isolation packer includes an annular cavity between said inner mandrel and each of said upper body, port valve, positioner mandrel, spacer coupling and lower body, said annular cavity being in fluid isolation from the inside of said inner mandrel; and said upper and lower bodies each have disposed therein radial bores located above said upper packer assembly and below said lower packer assembly, respectively, said bores intersecting said annular cavity to form a bypass around said isolation packer.

16. Apparatus of claim 14, wherein:

said slip joint port valve comprises a slip joint mandrel connected to said upper body, and a slip joint sleeve slidingly engaging a radially outer surface of said slip joint mandrel, and connected to said positioner mandrel.

17. Apparatus of claim 16, wherein:

said slip joint sleeve includes a lug slidingly engaging a short leg groove segment of an inverted J-shaped groove of said slip joint mandrel; and said slip joint port valve further comprises a means for retaining said lug in said short leg groove segment when said positioner mandrel is connected to said slip joint sleeve.

* * * * *